US007168503B1

(12) United States Patent
Teng

(10) Patent No.: US 7,168,503 B1
(45) Date of Patent: Jan. 30, 2007

(54) POWER HAND TOOL

(75) Inventor: Cheng-I Teng, Taichung County (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 11/322,404

(22) Filed: Jan. 3, 2006

(51) Int. Cl.
*B25D 11/00* (2006.01)

(52) U.S. Cl. ..... 173/48; 173/178; 173/216

(58) Field of Classification Search ..... 173/216, 173/217, 48, 128, 109, 176, 178
See application file for complete search history.

(56) References Cited

U.S. PATENT DOCUMENTS 5,449,043 A * 9/1995 Bourner et al. ..... 173/178
5,531,278 A * 7/1996 Lin ..... 173/176
6,457,535 B1 * 10/2002 Tanaka ..... 173/48
6,874,585 B2 * 4/2005 Zhao ..... 173/48
6,892,827 B2 * 5/2005 Toyama et al. ..... 173/48
6,926,095 B2 * 8/2005 Chen ..... 173/48
6,984,188 B2 * 1/2006 Potter et al. ..... 475/298
7,101,300 B2 * 9/2006 Milbourne et al. ..... 475/265

* cited by examiner

*Primary Examiner*—Scott A. Smith
(74) *Attorney, Agent, or Firm*—Bacon & Thomas, PLLC

(57) ABSTRACT

A power hand tool includes a housing that houses a motor, a transmission gear set, a torque control mechanism and an impact mechanism. The torque control mechanism has an adjustment device that is movable between a first position and a second position inside the housing by a rotation action to set a predetermined output torque of the power hand tool. The output torque of the power hand tool is at the minimum condition and the adjustment device stops the impact mechanism from working to prevent destruction to the torque setting of the power hand tool when the adjustment device is in the second position.

4 Claims, 4 Drawing Sheets

POWER HAND TOOL

BACKGROUND OF THE INVENTION

1. Field of the Invention

The present invention relates to power hand tools and more particularly, to a power hand tool having a torque control mechanism and an impact mechanism.

2. Description of the Related Art

A conventional power impact wrench is known comprising a motor, a transmission gear set, and an impact mechanism. The transmission gear set reduces the revolving speed of the rotary driving force of the motor to a predetermined level for output. The impact mechanism is adapted to produce an impact against the output shaft of the power hand tool intermittently and rapidly in same direction of rotation when the output shaft of the power hand tool encountered a resisting force that surpasses the output torque, for enabling the output shaft to overcome the resisting force and to keep working.

There is known an electric screwdriver, which comprises a motor, a transmission gear set, and a torque control mechanism. The transmission gear set reduces the revolving speed of the rotary driving force of the motor to a predetermined level for output. The torque control mechanism is adapted to set the maximum output torque of the electric screwdriver, preventing damage to the workpiece.

The aforesaid impact mechanism and torque control mechanism are designed to fit two reversed requirements. Normally, these two mechanisms do not coexist in a power hand tool. However, these two mechanisms may be required in a certain condition. For example, when a user uses an electric wrench to dismount a tire from a vehicle, the electric wrench needs an impact function to overcome the dismounting obstacle, which may be produced due to rust on the screw bolts at the tire or other reasons; in order to prevent damage to the screw bolts at the tire due to an excessive high torque when mounting the tire, it is necessary to have a torque setting function in the power hand tool. However, when arranging these two mechanisms in a power hand tool, the functioning of the torque setting mechanism may be damaged when starting the impact mechanism, and the impact mechanism fail to function when started the torque setting mechanism.

Therefore, it is desirable to provide a power hand tool having a torque control mechanism and an impact mechanism, which eliminates the aforesaid problem.

SUMMARY OF THE INVENTION

The present invention has been accomplished under the circumstances in view. It is therefore one object of the present invention to provide a power hand tool having a torque control mechanism and an impact mechanism, which allows switching of the impact mechanism between the working position and the non-working position.

To achieve this object of the present invention, the power hand tool comprises a housing that accommodates a motor, a transmission gear set, a torque control mechanism, and an impact mechanism therein. The torque control mechanism has an adjustment device that is movable between a first position and a second position inside the housing by a rotation action to set the output torque of the power hand tool. The output torque of the power hand tool is at the minimum condition and the adjustment device stops the impact mechanism from working to prevent destruction to the torque setting of the power hand tool when the adjustment device is in the second position.

DETAILED DESCRIPTION OF THE INVENTION

Figure 1:
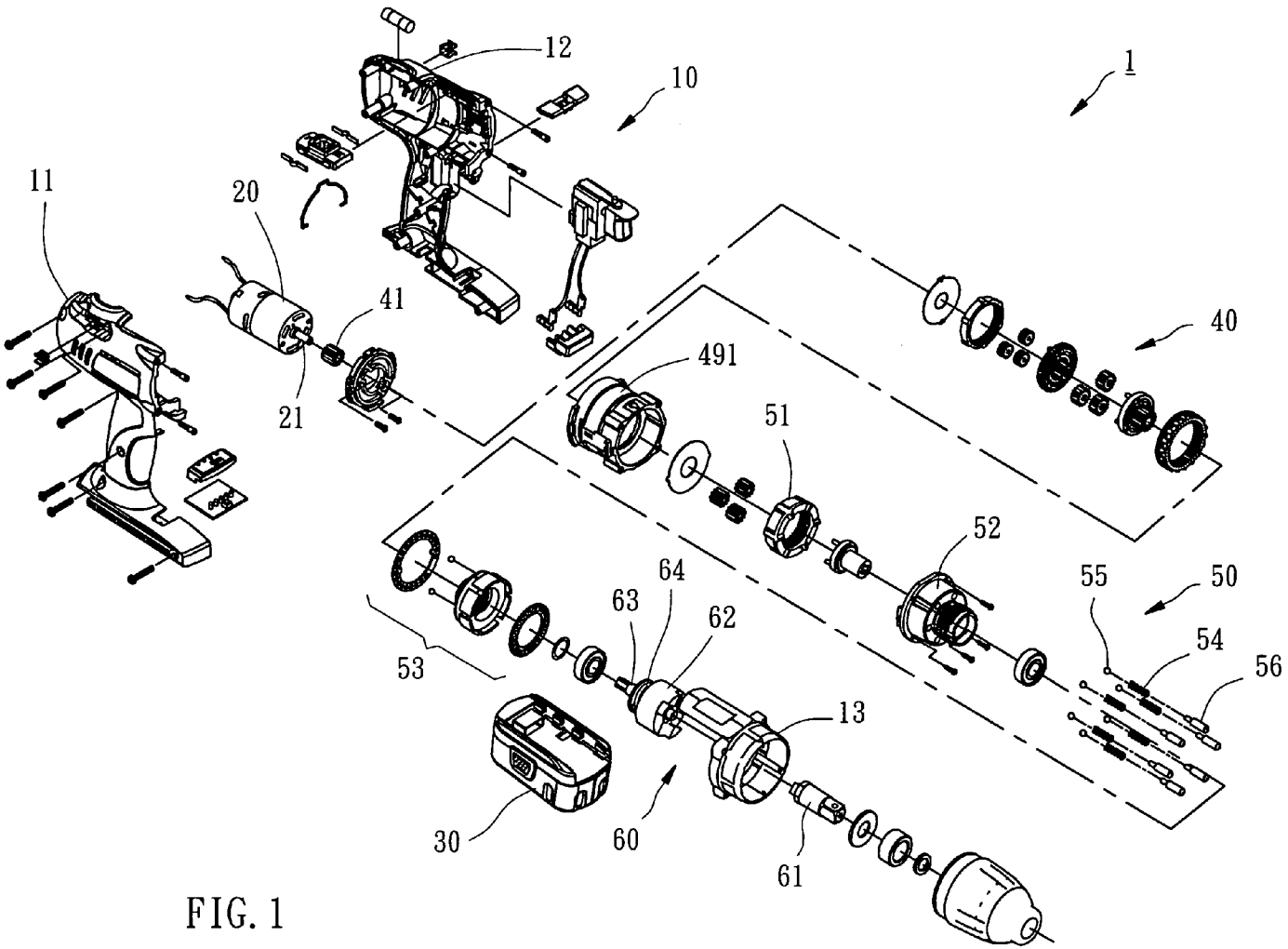
FIG. 1 is an exploded view of a power hand tool according to a preferred embodiment of the present invention.
Figure 2:
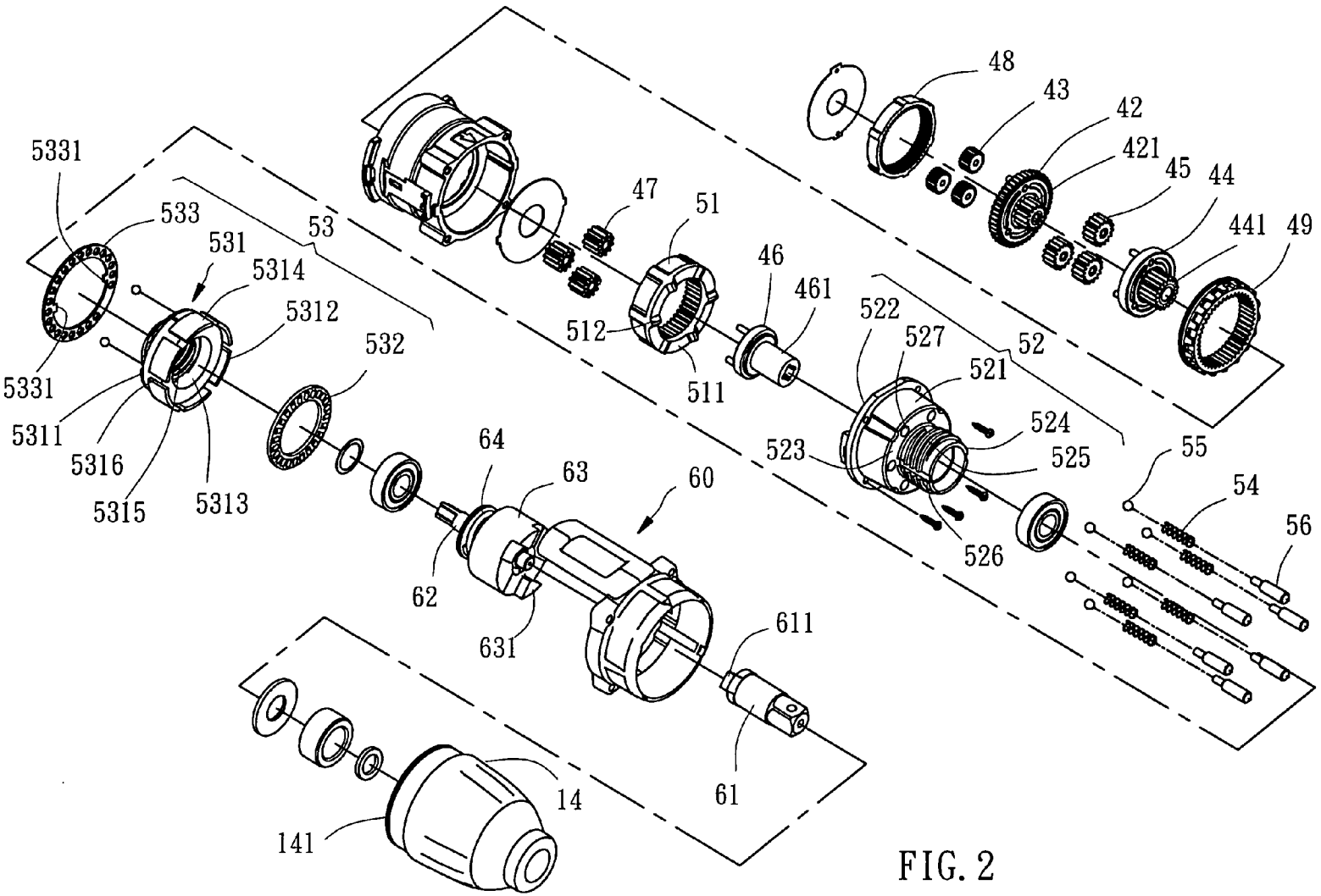
FIG. 2 is another exploded view in an enlarge scale of a part of the power hand tool according to the preferred embodiment of the present invention.
Figure 3:
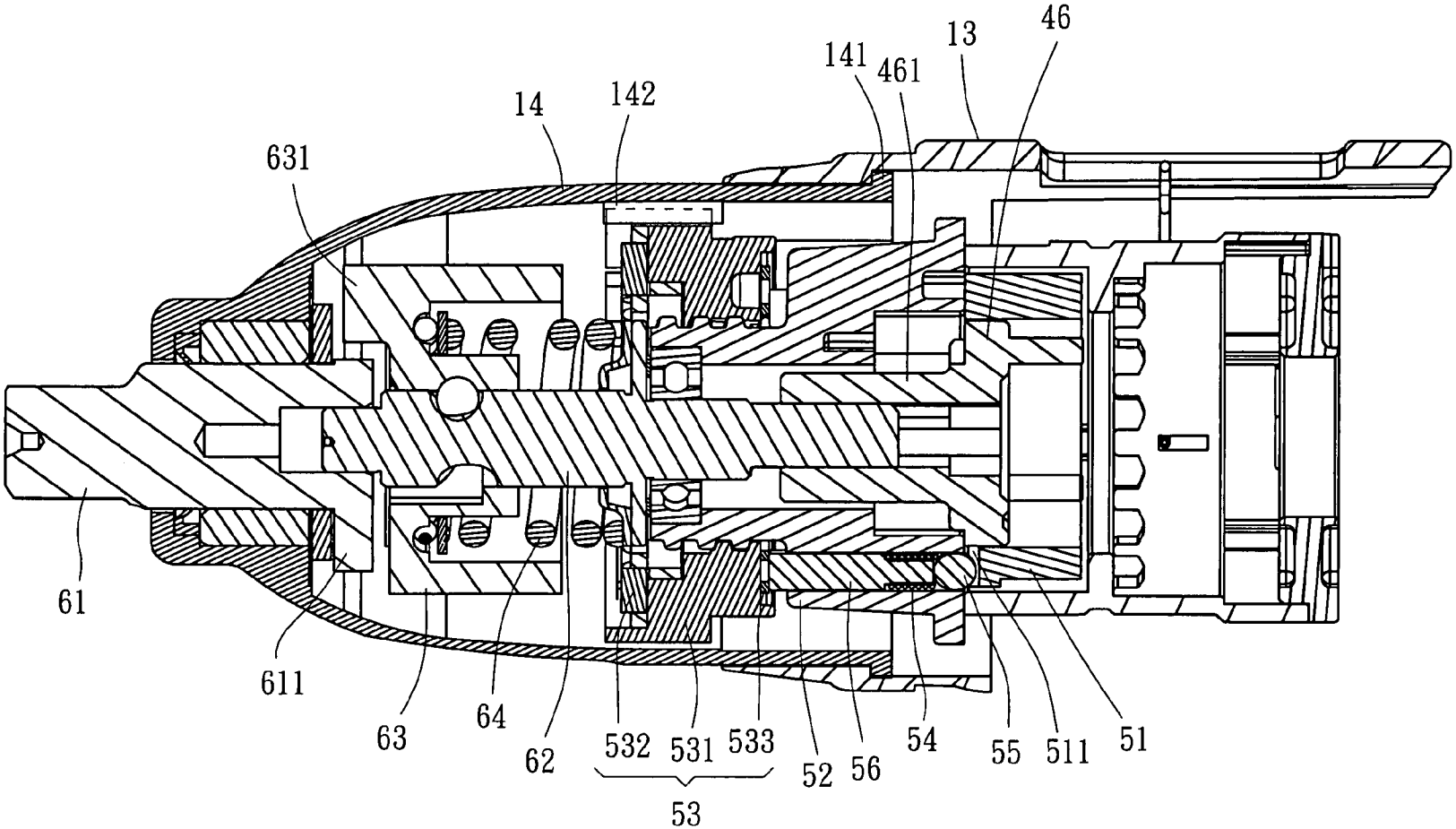
FIG. 3 is a schematic sectional view of the present invention showing the adjustment device is at the second position.

Referring to FIGS. 1–3, a power hand tool 1 in accordance with the present invention is shown comprised of a housing 10, a motor 20, a battery pack 30, a transmission gear set 40, a torque control mechanisms 50, and an impact mechanism 60.

The housing 10 is comprised of a left half shall 11, a right half shell 12, a front shell 13, and a front cap 14. The left half shell 11 and the right half shell 12 are abutted against each other. The front shell 13 is fastened to the front side of the abutted left half shell 11 and right half shell 12. The front cap 14 has a rear coupling flange 141 pivotally coupled to the inside wall of the front shell 13 in front of the left half shell 11 and the right half shell 12 for allowing rotary motion of the front cap 14 relative to the front shell 13, and a plurality of locating blocks 142 equiangularly spaced around the inside wall.

The motor 20 is fixedly mounted inside the housing 10, having a motor shaft 21.

The battery pack 30 is detachably mounted to the housing 10, and adapted to provide the necessary working electricity to the motor 20.

The transmission gear set 40 is mounted inside the housing 10, comprising a first sun gear 41 fixedly mounted on the motor shaft 21 of the motor 20, a first planet carrier 42, a second sun gear 421 provided at the center of the first planet carrier 42, a first planet gear set 43 rotatably supported on the first planet carrier 42 and meshed with the first sun gear 41, a second planet carrier 44, a third sun gear 441 provided at the center of the second planet carrier 44, a second planet gear set 45 rotatably supported on the second planet carrier 44 and meshed with the second sun gear 421, a third planet carrier 46, an output shaft 461 fixedly provided at the center of the third planet carrier 46, a third planet gear set 47 rotatably supported on the third planet carrier 46 and meshed with the third sun gear 441, a first internally toothed ring 48 meshed with the first planet gear set 43, a second internally toothed ring 49 selectively meshed with the second planet gear set 45 or the first planet carrier 42, and a barrel 491 affixed to the inside of the housing 10 to house the aforesaid parts of the transmission gear set 40. The transmission gear set 40 reduces the speed of the rotary driving force from the motor 20 for output through the output shaft 461. Further, shifting the position of the second internally toothed ring 49 changes the revolving speed of the output shaft 461. Because this transmission gear set 40 is a known design commonly used in conventional power hand tools, no further detailed description in this regard is necessary.

The torque control mechanism 50 comprises an internal gear 51, a holder shell 52, an adjustment device 53, a plurality of springs 54, a plurality of steel balls 55, and a plurality of pins 56.

The internal gear 51 is meshed with the third planet gear set 47 inside the housing 10, having an actuating end face 511 and a plurality of protruding portions 512 respectively extending from the actuating end face 511 and spaced from one another at an equal angle.

The holder shell 52 comprises a shell body 521 and a round shank 524. The shell body 521 has a first end face 522 and a second end face 523. The round shank 524 extends perpendicularly from the second end face 523 of the shell body 521, having an outer thread 525 around the periphery and two longitudinal sliding grooves 526 at two sides. The shell body 521 has a plurality of through holes 527 cut through the first end face 522 and the second end face 523. The holder shell 52 defines an axial hole 528 extending through the center of the shell body 521 and the center of the round shank 524. The holder shell 52 is fixedly mounted inside the housing 10 adjacent to one side relative to the internal gear 51 with the first end face 522 facing the actuating end face 511 of the internal gear 51.

The adjustment device 53 is comprised of an adjustment ring 531, a needle bearing 532, and a ring member 533. The adjustment ring 531 has a first end face 5311, a second end face 5312 opposite to the first end face 5311, an inside wall 5313, an outside wall 5314, an inner thread 5315 extending around the inside wall 5313 and corresponding to the outer thread 525 of the round shank 524 of the holder shell 52, and a plurality of locating grooves 5316 spaced around the outside wall 5314 and adapted to receive the locating blocks 142 of the front cap 14. The inner thread 5315 of the adjustment ring 531 is meshed with the outer thread 525 of the round shank 524 of the holder shell 52, keeping the locating grooves 5316 respectively coupled to the locating blocks 142. Therefore, rotating the front cap 14 causes the adjustment ring 531 to move along the round shank 524 of the holder shell 52 between a first position and a second position. The ring member 533 has two protruded positioning portions 5331 at the inner wall thereof. The ring member 533 is sleeved onto the round shank 524 of the holder shell 52 such that the two protruded positioning portions 5331 are respectively coupled to the longitudinal sliding grooves 526 of the holder shell 52 and the ring member 533 is located between the second end face 523 of the holder shell 52 and the first end face 5311 of the adjustment ring 531. The needle bearing 532 is attached to the second end face 5312 of the adjustment ring 531.

The springs 54 are respectively mounted in the through holes 527 of the holder shell 52.

The steel balls 55 are respectively stopped between the springs 54 and the actuating end face 511 of the internal gear 51.

The pins 56 are respectively inserted into the through holes 527 of the holder shell 52 and stopped between the springs 54 and the ring member 533 against the first end face 5311 of the adjustment ring 531.

Figure 4:
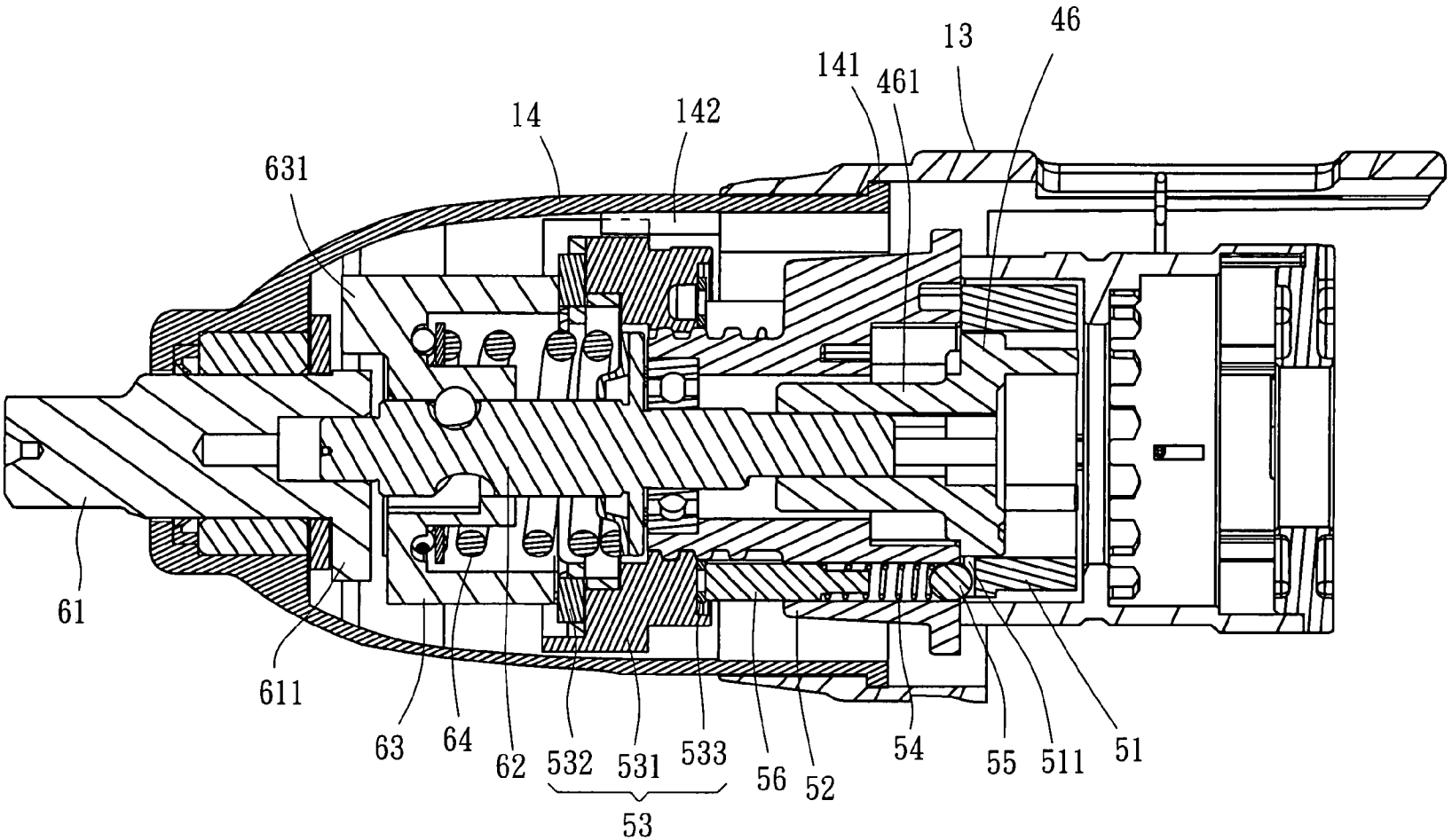
FIG. 4 is another schematic sectional view of the present invention showing the adjustment device is at first position.

When the adjustment ring 531 is in the first position as shown in FIG. 4, the steel balls 55 receive a first pressure from the springs 54. When the adjustment ring 531 is in the second position as shown in FIG. 3, the steel balls 55 receive a second pressure from the springs 54. The second pressure is greater than the first pressure.

When the internal gear 51 is locked and prohibited from rotary motion, the transmission gear set 40 reduces the revolving speed of the rotary driving force from the motor 20 for output through the output shaft 461. When the internal gear 51 is unlocked and allowed to rotate and when the output shaft 461 receives a resisting force, the internal gear 51 will be rotated, causing the transmission gear set 40 to run idle. When wishing to cause rotation of the internal gear 51, it is necessary to have the protruding portions 512 at the actuating end face 511 of the internal gear 51 overcome the pressure from the steel balls 55. Therefore, when the pressure from the steel balls 55 at the actuating end face 511 of the internal gear 51 is relatively increased, the internal gear 51 must receive a relatively greater rotary driving force to overcome the pressure from the steel balls 511, i.e., the output shaft 461 must receive a relatively greater resisting force to have the internal gear 51 be rotated, and this resisting force is the relatively maximum torque outputted from the output shaft 461 at that condition. Therefore, when the adjustment ring 531 is in the second position, the pressure from the steel balls 55 against the actuating end face 511 of the internal gear 51 reaches the maximum, and this pressure is the maximum torque that the output shaft 461 can output. When the adjustment ring 531 is in the first position, the pressure from the steel balls 55 at the actuating end face 511 becomes the least, and this pressure is the smallest output torque of the output shaft 461.

The impact mechanism 60 comprises a final output shaft 61, a transmission shaft 62, an impact element 63, and a spring member 64. The output shat 61 of the impact mechanism 60 is rotatably mounted in the front cap 14 and partially extended out of the front cap 14, having a coupling portion 611 at one end. The transmission shaft 62 is coupled to the output shaft 461 of the second planet carrier 46 of the transmission gear set 40 for synchronous rotation with the output shaft 461. The impact element 63 is sleeved onto the transmission shaft 62 and axially movable along the transmission shaft 62 between two positions, namely, the third position and the fourth position. The impact element has a coupling portion 631. When the impact element 63 is in the third position, the coupling portion 631 of the impact element 63 is kept coupled to the coupling portion 611 of the final output shaft 61 of the impact mechanism 60, allowing rotation of the final output shaft 61 with the transmission shaft 62 and the output shaft 461 of the second planet carrier 46 of the transmission gear set 40. When the impact element 63 is in the fourth position, the coupling portion 631 of the impact element 63 is disengaged from the coupling portion 611 of the final output shaft 61 of the impact mechanism 60. The spring member 64 is supported between the transmission shaft 62 and the impact element 63 to hold the impact element 63 in the third position.

Further, when the adjustment ring 531 is in the aforesaid first position, the second end face 5312 is pressed on the needle bearing 532 against the impact element 63 to hold the impact element 63 in the aforesaid third position, prohibiting movement of the impact element 63 to the aforesaid fourth position.

Referring to FIG. 4 and FIG. 3 again, when the user rotated the front cap 14 to move the adjustment ring 531 to the aforesaid second position as shown in FIG. 3, the output torque of the output shaft 461 of the transmission gear set 40 reaches the maximum. When the final output shaft 61 receives a resisting force at this time, the impact element 63 is forced to move from the aforesaid third position to the aforesaid fourth position and then disengaged from the final output shaft 61. At the time the impact element 63 disengages from the final output shaft 61, the spring member 64 immediately pushes the impact element 63 back to the third position to force the coupling portion 631 of the impact element 63 into engagement with the coupling portion 611 of the final output shaft 61, thereby achieving the designed impact effect. This impact effect won't stop till the resisting force received by the final output shaft 61 is reduced.

When the user rotated the front cap 14 to move the adjustment ring 531 to the aforesaid first position, the output torque of the output shaft 461 of the transmission gear set 40 reaches the minimum, and the adjustment ring 531 is stopped at the needle bearing 532 against the impact element 63 to hold the impact element 63 in the aforesaid third position. When the final output shaft 61 receives a resisting force at this time, the adjustment ring 53 prohibits the impact element 63 from moving to the fourth position, and therefore the impact mechanism 60 cannot produce an impact effect at this time. If the resisting force received by the final output shaft 61 surpasses the torque outputted from the output shaft 461 of the transmission gear set 40 at this time, the internal gear 51 will be rotated to interrupt transmission of force from the motor 20 to the output shaft 461 of the transmission gear set 40. Therefore, the power hand tool 1 can only output the set torque, preventing the production of a transient high torque due to the effect of the impact mechanism 60, thereby preventing damage to the workpiece.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A power hand tool comprising:

a housing;

a motor fixedly mounted inside said housing, said motor having a motor shaft;

a transmission gear set mounted inside said housing, said transmission gear set comprising at least one sun gear coupled to said motor shaft, at least one planet carrier, at east one planet gear set rotatably mounted on said planet carrier and rotatable by said sun gear directly or indirectly, and an output shaft fixedly provided at said planet carrier;

a torque control mechanism comprising:

an internal gear meshed with said planet gear set inside said housing, said internal gear having an actuating end face and a plurality of protruding portions annularly, equiangularly and spacedly located at said actuating end face;

a holder shell fixedly mounted inside said housing adjacent to one side of said internal gear, said holder shell having a shell body, a round shaft having an outer thread, and an axial hole running through said shell body and said round shank, said shell body having a first end face facing the actuating end face of said internal gear, a second end face from which said round shank perpendicularly extends, and a plurality of through holes running through the first end face and the second end face;

an adjustment device having an adjustment ring which is provided with an inner thread meshed the outer thread of the round shank of said holder shell and rotatable to move said adjustment device between a first position and a second position;

a plurality of spring members respectively mounted in the through holes of said holder shell;

a plurality of steel balls respectively stopped between the spring members and the actuating end face of said internal gear; and a plurality of pins respectively inserted into the through holes of said holder shell and stopped between the spring members and said adjustment device for enabling said steel balls to receive a first pressure from the spring members when said adjustment device is in said first position and for enabling said steel balls to receive a second pressure from the spring members when said adjustment device is in said second position; wherein the second pressure is greater than the first pressure; and an impact mechanism comprising a final output shaft, a transmission shaft, an impact element, and a spring member, said final output shaft being rotatably mounted in said housing and partially extended out of said housing, said final output shaft having a coupling portion at one end thereof, said transmission shaft being coupled to the output shaft of said transmission gear set for synchronous rotation with the output shaft of said transmission gear set, said impact element being sleeved onto said transmission shaft and axially movable along said transmission shaft between a third position and a fourth position, said impact element having a coupling portion, the coupling portion of said impact element being coupled to the coupling portion of said final output shaft for allowing rotation of said final output shaft with said transmission shaft and the output shaft of said transmission gear set when said impact element is located at said third position, the coupling portion of said impact element being disengaged from the coupling portion of said final output shaft when said impact element is located at said fourth position, the spring member of said impact mechanism being supported between said transmission shaft and said impact element to hold said impact element in said third position;

wherein said impact element is stopped by said adjustment device in said third position and prohibited from moving to said fourth position when said adjustment device is in said first position.

2. The power hand tool as claimed in claim 1, wherein said housing comprises a rotary front cap provided with a plurality of locating blocks equiangularly spaced around an inside wall thereof; said adjustment ring comprises a plurality of locating grooves equiangularly spaced around the periphery thereof and respectively coupled to the locating blocks of said rotary front cap for enabling said adjustment ring to be moved along said round shank of said holder shell between said first position and said second position upon rotation of said rotary front cap.

3. The power hand tool as claimed in claim 1, wherein said adjustment ring has a first end face and a second end face opposite to the first end face; said adjustment device further comprises a needle bearing attached to the second end face of said adjustment ring for enabling the second end face of said adjustment ring to stop at said needle bearing against said impact element and to hold said impact element in said third position and to prohibit movement of said impact element toward said fourth position when said adjustment ring is in said first position.

4. The power hand tool as claimed in claim 3, wherein said round shank of said holder shell has two longitudinal sliding grooves symmetrically disposed at two opposite sides; said adjustment device further comprises a ring member mounted on the round shank of said holder shell between the second end face of said holder shell and the first end face of said adjustment ring, said ring member having two protruded positioning portions respectively coupled to the longitudinal sliding grooves of said round shank of said holder shell.

* * * * *